US006129290A

United States Patent [19]

Nikkanen

[11] Patent Number: 6,129,290

[45] Date of Patent: Oct. 10, 2000

[54] SNOW MAKER

[76] Inventor: John P. Nikkanen, 47 Selden Hill Dr., W. Hartford, Conn. 06107

[21] Appl. No.: 09/187,625

[22] Filed: Nov. 6, 1998

Related U.S. Application Data

[60] Provisional application No. 60/064,489, Nov. 6, 1997.

[51] Int. Cl.[7] ..... F25C 3/04

[52] U.S. Cl. ..... 239/2.2; 239/14.2; 239/132.1; 239/135; 239/423; 239/425; 239/433; 239/280.5; 239/553.3; 239/567; 239/600

[58] Field of Search ..... 239/2.2, 14.2, 239/128, 132.1, 135, 403, 405, 406, 418, 419, 423, 425, 433, 462, 553, 567, 590, 553.3, 553.5, 559, 600, 601, 280, 280.5

[56] References Cited

U.S. PATENT DOCUMENTS

| | | | |
|---|---|---|---|
| 3,774,842 | 11/1973 | Howell | 239/2.2 |
| 3,908,903 | 9/1975 | Burns, Jr. | 239/25 |
| 3,923,246 | 12/1975 | Cloutier et al. | 239/403 X |
| 4,101,073 | 7/1978 | Curran | 239/14.2 |
| 4,493,457 | 1/1985 | Dilworth et al. | 239/12.2 |
| 4,793,554 | 12/1988 | Kraus et al. | 239/2.2 |
| 4,813,597 | 3/1989 | Rumney et al. | 239/14.2 X |
| 4,919,331 | 4/1990 | Kosik, Sr. et al. | 239/559 X |
| 5,083,707 | 1/1992 | Holden | 239/14.2 X |
| 5,167,367 | 12/1992 | VanderKelen et al. | 239/2.2 |
| 5,400,966 | 3/1995 | Weaver et al. | 239/202 |
| 5,810,249 | 9/1998 | Nilsson | 239/2.2 |
| 5,810,251 | 9/1998 | McKinney | 239/2.2 |
| 5,884,841 | 3/1999 | Ratnik et al. | 239/418 X |

OTHER PUBLICATIONS

Ratnik Industries "Oscillating Snow Guns on Tower" May 5, 1991, PL No. 911, 2 pages.

Ratnik Industries "Snow Giant II on a Tower" May 15, 1985, PL No. 928, 1 page.

Snow Economics, Inc. "HKD Standard Tower" 1998, 1 page.

Snow Economics, Inc. Advertisement, Ski Area Management Magazine, Nov. 1993, 1 page.

*Primary Examiner*—Andres Kashnikow
*Assistant Examiner*—Steven J. Ganey
*Attorney, Agent, or Firm*—C. G. Nessler

[57] ABSTRACT

A snowmaker is comprised of a head which has an outer ring of nozzles which form a flow of primary water into droplets which move downstream preferably along paths running at a slight radially outward angle, together with a central nucleator which discharges frozen nuclei particles outwardly from a plurality of atomizers at the downstream end cap end of the nucleator. The nucleator is readily disconnectable from the ring. Secondary water flow is fed to the nucleator so it swirls at high velocity within, to greatly enhance the warming effect of the water on the nucleator parts, and to thereby inhibit accumulation of exterior ice. The secondary water is mixed with compressed air as they both enter the atomizers of the end cap. A resultant flow of nuclei from the atomizers is discharged so the flow merges with the plume of primary water droplets from the nozzle. Preferably, flat spray nozzles are used. The lengths of the oblong cross sections of spray pattern are oriented so they lie along the radii of the head; and, the atomizers are oriented so they intersperse nuclei between the spaced apart spray patterns. Desirable air/water ratios of up to 170:1 are obtained by the nucleator. The head mounts on a portable tower and effectively projects snow without fan augmentation.

23 Claims, 6 Drawing Sheets

SNOW MAKER

This application claims benefit of provisional application Ser. No. 60/064,489, filed Nov. 6, 1997.

TECHNICAL FIELD

The present invention relates to devices for making artificial snow, in particular, to devices which use water and air to form and project snow over outdoor areas, such as ski slopes.

BACKGROUND

For a number of years it has been the practice to employ equipment to deposit artificially made snow on outdoor surfaces, such as ski slopes, when nature does not provide the desired quantity of snow. A variety of mechanical devices have been employed.. Generally, the approach is to take water droplets and convert them to frozen particles. Prior art devices typically break up a stream of water by means of pressure atomizing and or two-fluid (air-water) atomizing. Often fans are used to provide an airstream which entrains the droplets as they become frozen, and better to carry them through space and deposit them across a wide area.

There are various problems and limitations connected with prior art snow making devices. They include complexity, noise, reliability, weight, difficult maneuverability, low efficiency in covering a desired area, poor ability for making snow at comparatively warm temperatures, high initial cost, and high operating cost. Of the various factors, there are three upon which the present invention is intended to improve, as follows.

First, there is often a tendency for the snow makers to freeze up or become coated with ice from the water being atomized, especially in severe cold and certain wind conditions. In other instances debris clogs fine nozzles. Thus, users, want reliability in the sense that the snowmaker can be depended upon to make snow without frequent operator intervention, to remove ice buildup or unclog nozzles.

Second, a snowmaking system ought have low operating and maintenance costs. Since many snowmakers use compressed air, as does the present invention, good use must be made of such air, since the cost of operating and maintaining compressors is a major factor. So, the air/water ratio ought be minimized.

Third, snowmakers ought be able to make snow when ambient conditions are near to the freezing point of water and relative humidity (wet bulb temperature) is high. It is comparatively easy to make snow when the temperature and humidity are low, for instance when the dry bulb and wet bulb temperatures are less than 20° F. However, when temperatures are "high"—in the 20–32° F. range, many snowmakers will undesirably deposit on a slope a fine coating of ice, slush or water, because the water droplets insufficiently freeze as they are carried through the air toward the earth. Thus, especially when ski slopes are not located in inherently colder regions, ski slope operator income can be substantially affected by the ability to make good amounts of snow in marginal (high) temperature and humidity conditions..

Several commercial snowmakers make snow by atomizing water with compressed air to form fine frozen particles, or nuclei. The fine ice particles are combined with separately formed streams of water droplets which comprise the preponderance of the water flow through the snowmaker. The fine particles act as nuclei since they cause the droplets to freeze and drop to the earth as artificial snow. In their absence, the droplets by themselves typically will not readily freeze before falling to earth.. The parts of the apparatus which generate the frozen particles, called the nucleator, tend to be prone to inherent freezing, and sometimes electric heaters are provided to avoid such. However, when the snowmaker does not have a fan, requiring a heater necessitates additional complication and cost in providing the unit with electricity.

While there are snowmakers which have superior performance at the high ambient temperatures, they also tend to be the most complex and costly. Some high performance snow makers generate fine droplet sprays by using fine orifices. But unfortunately, the water supplies used in the field often have solid particulate and dirt, and careful filtering (and resultant maintenance) is required, elsewise clogging or inferior performance results. The present invention seeks to improve on the limitations of the prior art snowmakers.

The foregoing and other objects, features and advantages of the invention will become more apparent from the following description of preferred embodiments and accompanying drawings.

SUMMARY

An object of the invention is to provide a snow maker which is light in weight, economic to manufacture, reliable, and which provides good utilization of compressed air. A further object is to provide in such a snow maker the capability of making snow at ambient temperatures which tend to approach the freezing point of water. A still further object is to avoid accumulation on a snowmaker of ice which interferes with snowmaking.

In accord with the invention, a snowmaker has a head comprised of a central nucleator, for generating frozen ice particles, or nuclei, and an array of water nozzles spaced apart around the nucleator. Water provided to the snowmaker is divided into two principal fractions, as by a pipe tee and predetermined flow path resistances. The first fraction, called primary water, is pressure atomized by the nozzles, to provide a spray of droplets which is directed generally downstream along a central axis, with a preferable radially outward component. The second water fraction, called secondary water, is flowed through the nucleator to ultimately merge with compressed air. The air and water are discharged through a plurality of atomizers at the downstream end of the nucleator, and frozen particles are formed which are nuclei. The downstream or atomizer end of the nucleator is preferably positioned somewhat downstream from the location of the nozzle array. The nuclei are directed downstream and radially outward at an angle, which angle is steeper than the preferred radially outward angle that characterizes the path of the primary water droplets, so the nuclei intersect the droplets and induce them to freeze. Snow is formed by the head in natural air conditions, that is, in air which is not set in motion by means of a fan or other mechanical air mover.

The water provided to the nucleator provides two functions. First, it warms the nucleator and prevents freezing. Second, it enables the nucleator to generate a bimodal distribution of ice particle sizes. Very fine particles of the order of 0.01–0.1 microns mean diameter are intermixed with fine particles of the order of 20 microns. Preferably, each nozzle provides a "flat" spray pattern, or one in which the cross section of the water droplet spray is oblong. The length of each nozzle oblong preferably lies along a radius running from the central axis of the nucleator. Less preferably, conical spray pattern nozzles may be used. The nuclei are projected radially outwardly, preferably by atomizers offset circumferentially relative to the positions of the nozzles, so that a substantial significant quantity of nuclei will be aimed into the spaces between the radially disposed primary water droplet patterns.

In another aspect of the invention, the nucleator lies along a central axis and the nozzles are mounted on a circumscribing hollow ring which is readily disconnectable by means of a fitting from the nucleator to facilitate mass change in nozzles.

In further accord with the invention, secondary water flowing into the nucleator is caused to swirl around the inside of the nucleator, so it moves helically through selected portions of the nucleator, to thereby increase heat transfer to the nucleator parts and prevent ice accumulation on the exterior. This effect is preferably achieved both along the body of the nucleator and at the downstream end where air combines with the water to flow through the atomizers, as follows. At the upstream end of the nucleator the water is swirled by means of a first swirl plate to warm the shell or main body of the nucleator. Solid particulates are also separated from the water by the swirl, and retained in a first chamber portion. The water then flows through one or more orifice plates, and then through a second swirl plate having small tangential holes. The water continues downstream to the interior of an end cap located at the downstream end of the nucleator, to also warm the cap by high circumferential velocity without included compressed air. The water flows into the openings of a plurality of atomizers around the periphery of the cap, where it is first merged with compressed air which is delivered to the cap by a central air tube. The pressure drop and expansion of the air and water through the atomizers cause both breakup of the water stream and extreme cooling of the air.

In other embodiments of the invention, a portion of the water flowed to the nucleator is discharged through one or more separate channels in the cap, without any air, for the principal purpose of increasing the total flow of water through, and thus the warming of, the nucleator. In another embodiment of the invention, a vortex tube is placed interior of the air tube and the cap, so that separate streams of hot and cold compressed air are generated. The hot air stream is directed to the cap, to heat it.

A snowmaking head in accord with the invention, being light in weight, is preferably mounted atop a light weight tower. The tower is comprised of boom which pivots to a desired angle for snow making operation, from horizontal to 90 degrees from horizontal. The boom is mounted on a support. The support is mounted on a base which has three arms, at the ends of which are two wheels and a support pad. The arm with the support pad can be rotated downwardly, so the base can be made horizontal on a hillside, and the arm can be used to pull or push the base on the wheels, to relocate the snowmaker.

DESCRIPTION

Figure 1:
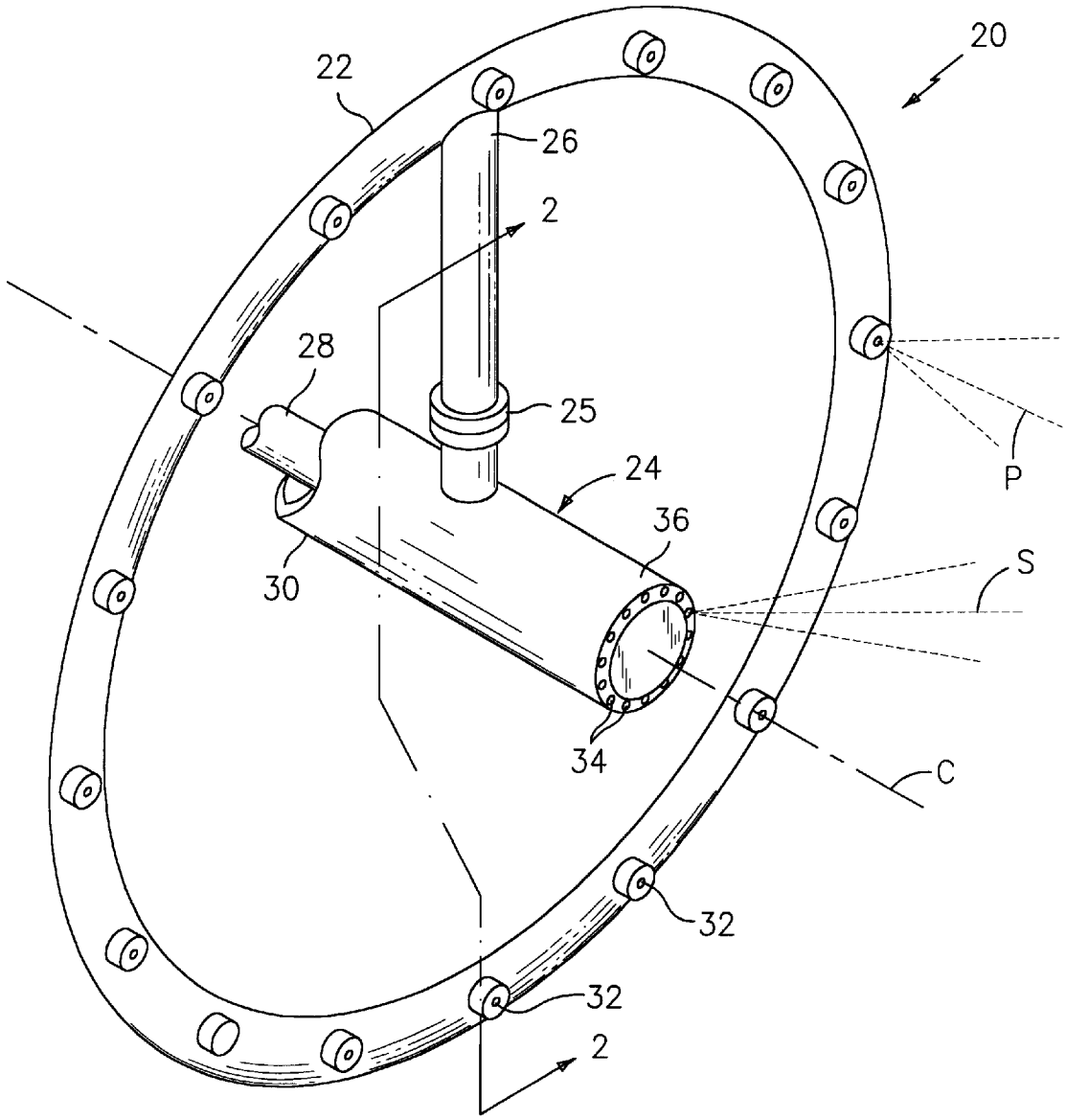
FIG. 1 shows a snow making head comprised of a nucleator and nozzle ring, in perspective view.
Figure 2:
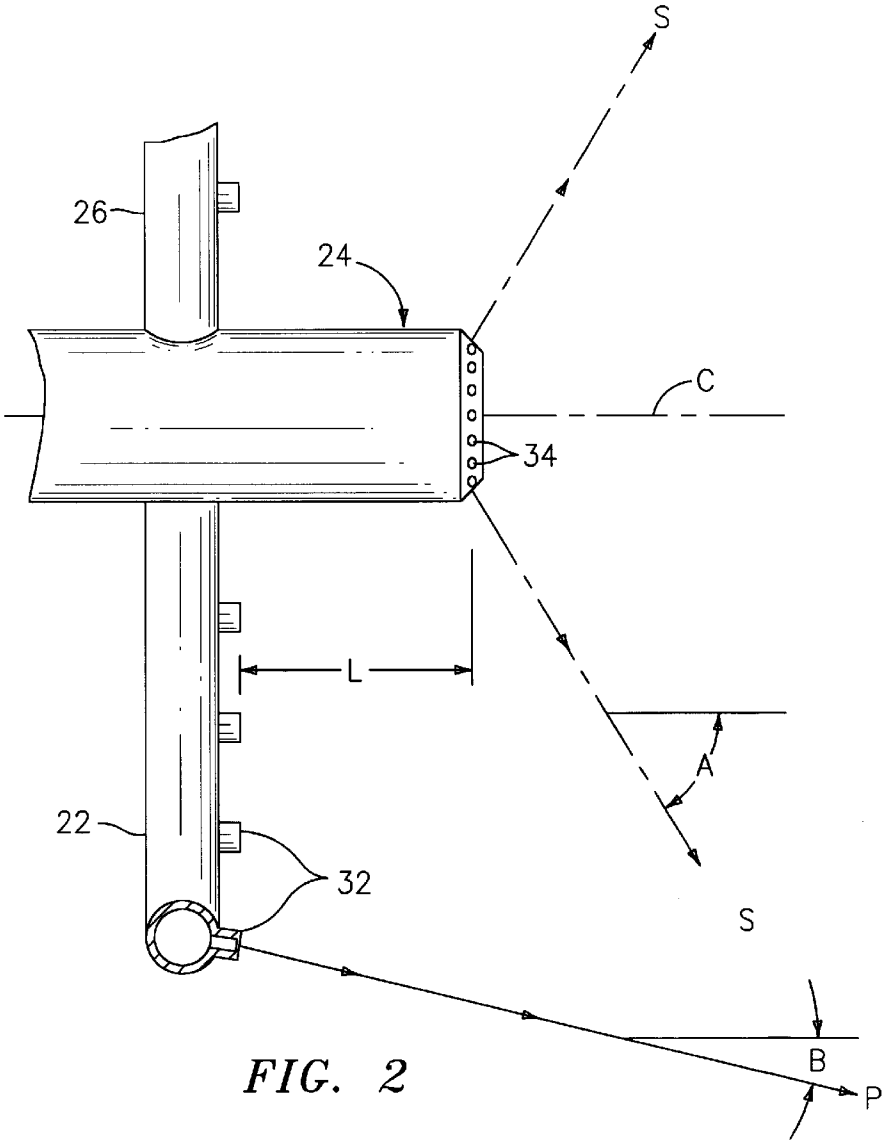
FIG. 2 is a partial cross section through the head shown in FIG. 1.

The head 20 of a snow making apparatus is shown in perspective view in FIG. 1 and in partial cross section view in FIG. 2. As described further below, the head is mounted on top of a tower, so it is elevated above the area which is to be coated with snow. The head 20 is comprised of a ring 22 and a nucleator 24 lying along the longitudinal center axis C of the ring. The head is generally fabricated from aluminum alloy. The function of the nucleator is to generate fine particles of frozen water, or nuclei, which intermingle with the water droplets generated from the ring. High pressure water is delivered to the head from a source by means of feed line 30 which runs into the nucleator, coaxially with the air line 28. Some of the water, called secondary water, is used in the nucleator while the bulk of the water flow, referred to as the primary water/flow, runs to the hollow tubing of which the ring is comprised by means of distributor pipe 26. A plurality of water spray nozzles 32 are evenly spaced apart around the ring. A fine spray of primary flow water droplets is discharged from the spray nozzles 32 of the ring, so it flows generally in a downstream direction, that is, generally along axis C. The nozzles 32 are referred by such name in this description for convenience of distinguishing them from the atomizers 34 of the nucleator. The nozzles 32 are preferably commercial pressure atomizers, described further below by example, which discharge a so-called flat spray pattern. By this is meant that the cross section of the droplet array will be oblong, compared to the characteristic circular cross section that is provided by familiar conical type nozzles. When there are a large number of nozzles, the nozzles are preferably arranged so that length of the oblong of the spray pattern cross section runs radially from the center of the head. See FIG. 9.

Generally, a nucleator is a device which generates nuclei. The nucleator 24 does this and it is also an assembly for merging pressurized air and secondary water, and discharging the mixture from atomizers 34. The thermodynamic conditions produced just downstream of the atomizers convert the water issuing from the atomizers into frozen water (ice) particles. Such particles are called nuclei because their function is to intermix with the water droplets from the nozzles, whereupon they will induce the nucleation of ice crystals within the droplets of the nozzle spray, thus converting them into ice, or artificial snow. There is a plurality of atomizers 34 at the front end 36 of the nucleator. The atomizers will generally discharge a narrow conical spray of droplets.

As will be understood from the description herein, the means by which the water flowed to the head is divided into the aforementioned primary and secondary flows is preferably by the essential tee formed by pipe 26 and upstream end of the nucleator, in combination with the comparative effects of flow resistance along the one path which goes to and through the nozzles, and the other path which goes to and through the atomizers. Thus, how the water is divided, and the amount of water which embodies either primary or secondary fraction, are functions of all the particulars of the design which will be described; and the fractions may accordingly be adjusted. In the generality of the invention, the water and air may be provided in non-coaxial fashion. And common valves may be placed in two separate water lines, one flowing to the ring and one to the nucleator, to thereby provide means for division of the flow.

Figure 3:
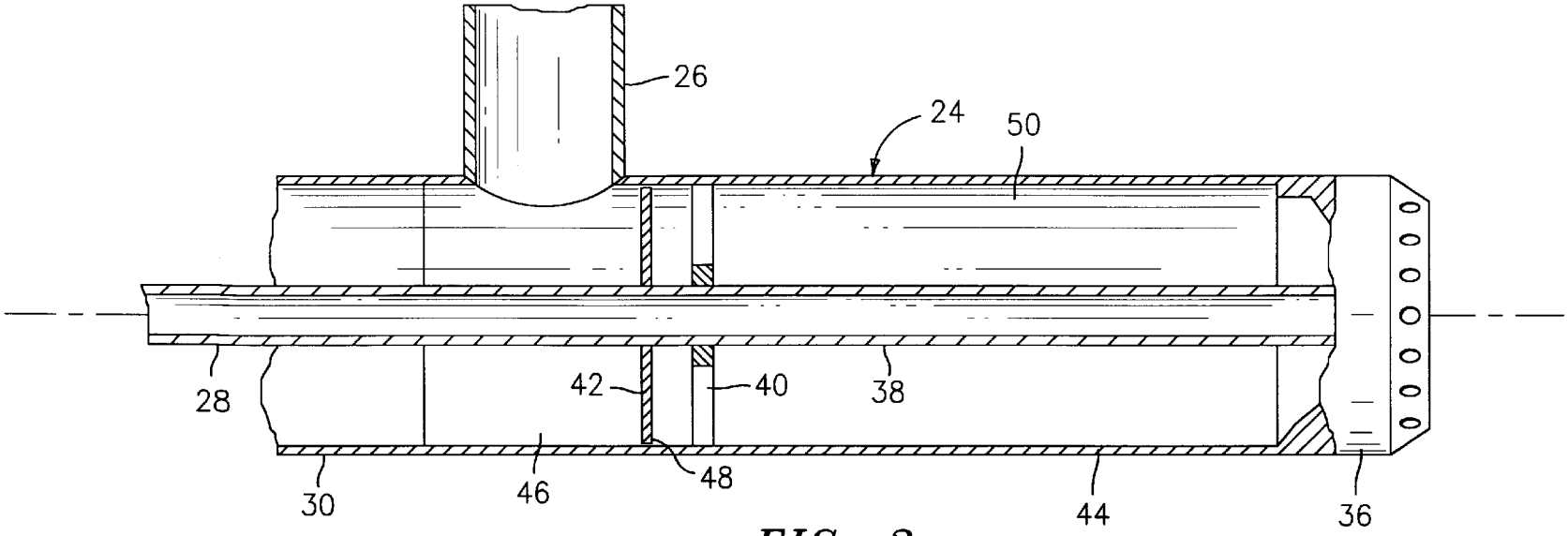
FIG. 3 is a longitudinal cross section of a nucleator.

FIG. 3 shows a nucleator 24 in partial cross section. Generally, water flows from the rear end to the front end where it is discharged from the cap. Water, called secondary flow water to contrast it with the water which flows to the nozzles, enters through water feed pipe 30, and runs into the interior of the cylindrical shell 44. Air flows through the air feed pipe 28, and runs through the central air tube 38 to the front end 36 of the nucleator. In the drawing the water pipe 30 has the same diameter as the shell 44.

As mentioned, the pipes 30, 28 run in coaxial fashion to the source at the base of the tower on support on which the head is mounted. The pipes may be bent near the nucleator, to provide the head with a desired gross discharge angle when it is supported by the feed pipes. The pipes 30, 28 will typically will be configured for quick connection and disconnection by well known types fittings. The distributor pipe 26 is characterized here as running from the nucleator but a pipe running from the inlet pipe 30 near the nucleator will be its equivalent. Thus for the invention, the characterization that the distributor pipe runs to the nucleator ought be comprehended to include both configurations. A connector 25, such as a typical pipe union, is present in the length of the distributor pipe 26, as shown in FIG. 1. The connector enables a nucleator to be conveniently used with multiple spray rings 22 (and vice versa). So, when desired, the number and characteristics of the nozzles can be quickly changed by changing rings. This provides a convenient way of adapting the head to varied environmental conditions.

Figure 4:
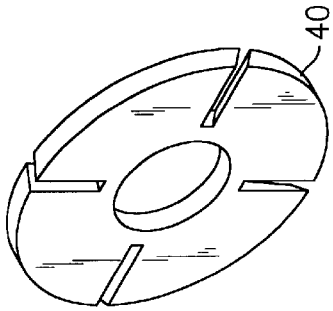
FIG. 4 shows a slotted orifice plate.

Referring again to the nucleator and FIG. 3, supply water flows into the first chamber 46, and from there the primary water fraction flows both out pipe 26 to the ring and nozzles. The secondary water fraction flows through the narrow 0.030 inch radial gap 48 between the circular restrictor disk 42 and the shell 44. The purpose of the small gap is to act as a filter and block solid particulate. A screen or other filter media may be substituted. Secondary water. Water then flows through the swirl plate 40. The swirl plate has 2 to 4, preferably 4, radial slots as shown in FIG. 4, and the exit velocity of the water from the slots is of order of 10 fps (feet per second). The purpose of the swirl plate is to make the water flow circumferentially, and thus in a helical pattern, as it passes lengthwise through second chamber 50, flowing toward the front end 36 of the nucleator. The circumferential velocity is very much larger than, more than a thousand times, the axial water velocity which typically is about 0.04 fps.

The swirling flow increases the Reynolds Number, and thus decreases the water boundary layer thickness, and thus increases the heat transfer between the water and the interior surface of the shell 44. Heat is conducted through the metal shell, warming the exterior surface to above freezing point of water. This diminishes the tendency for ice to accrete on the exterior of the nucleator which is exposed to the ambient air that is necessarily below the freezing point. From the comparative axial and circumferential velocities in the preceeding paragraph, it will be appreciated that there will be negligible turbulence in the absence of the water swirl; and as a result laminar flow, a thick boundary layer, and limited heat transfer. A calculation shows that swirling flow of water increases the heat transfer film coefficient at the interior surface of the shell 44 to the order of 5000 Btu/hr/sq ft/° F. Calculations indicate that when the water is at least 33° F. and is swirled as indicated, the exterior surface of the shell, when made of aluminum alloy, such as Type AISI 6061, will be kept from freezing when the ambient temperature is as low as minus 10° F., even with wind produced external surface film coefficients of the order of 50 Btu/hr/sq ft/° F. The same kind of swirling and heat transfer beneficially affects the cap of the nucleator as indicated below.

The swirling the water further separates out solid particulate which is in the water and which could plug the fine orifices of the nucleator. The swirling action within the hollow cylindrical chamber creates a centrifugal acceleration of 20–30 G (where G is the acceleration due to the earth's gravity) on particles. The heavier particulate is thus forced to move radially outward, against the interior surface of shell 44. Particles which are lighter relative to water density will tend to settle against the outside surface of air tube 38. The effect could also be achieved in a less desirable design of nucleator where there was no central air tube.

Water then flows from second chamber 50 through openings 52 of distributor 54. The openings are located radially in between, preferably at the midpoint between, the outside diameter of the air tube and the inside diameter of the shell. See FIG. 5. Thus, comparatively clean secondary water is passed from the chamber, as the solid particles are left behind. Accumulated particles in chamber 50 and upstream at orifice 42 may be periodically removed by reverse flushing the nucleator, or by use of ports which are not shown, or by disassembly of the nucleator, which will be suitably constructed in obvious ways to facilitate such.

Figure 6:
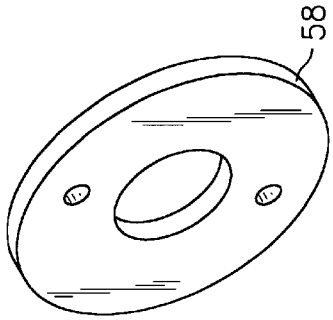
FIG. 6 shows an orifice plate having angled through-holes.
Figure 5:
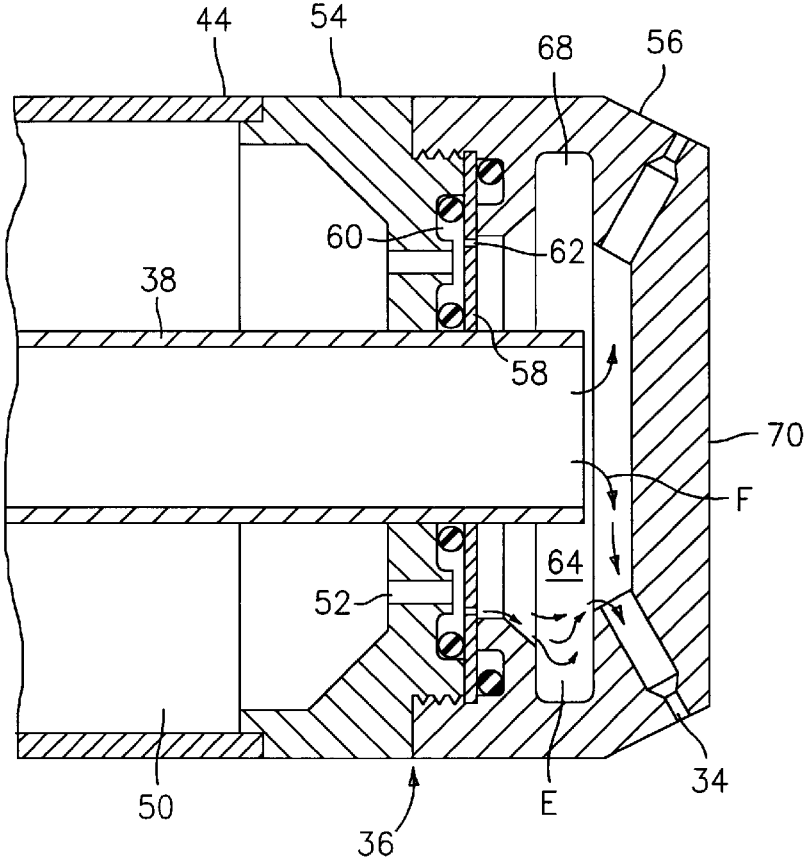
FIG. 5 is a longitudinal cross section of the front end of the nucleator shown in FIG. 3.

FIG. 5 shows other details of the interior of the nucleator, that is, the front (or downstream) end 36 of the nucleator 24. Distributor 54 is welded or otherwise attached to the shell 44. A cap 56 is attached by threads to the distributor. It will be understood that other means of mechanically configuring the diverse parts of the nucleator are within contemplation, for reasons of access, cost, etc. Orifice plate 58 is captured between the distributor and cap. O-rings form seals between the components. The distributor 54 has a plurality of axial openings 52, preferably four, of 0.150 inch diameter. Water from chamber 50 flows through the openings 52 into third chamber 60. There is relatively little pressure drop intended during the passage of water through the openings 52. The orifice plate 58 is 1/16 to 1/8 inch thick and has two small 0.030 inch diameter holes 62 running tangentially with an angle of 65 degrees to the centerline C (i.e., lying at a 25 degree angle to the planar surface of the orifice plate). See FIG. 6. Other numbers, diameters and angles of holes can be used. The total area of the holes will largely determine the flow to the atomizers. The orifice plate is easily changed by removal of the end cap. Because of the small flow area of the holes 62 compared to the area of the restrictions upstream and downstream, there is a desired substantial pressure drop across the orifice plate and resultant high velocity. When the water is discharged tangentially from the holes 62 into chamber 64, at a calculated 200 fps, it runs radially outward and downstream along the interior wall of the cap 56, as indicated by the arrows E in FIG. 5. Friction with the cap wall reduces the velocity of the water to about 50 fps. Even so, a centrifugal force field of about 500 G is calculated as being produced within the water, and this importantly trivializes any effect of gravity on the water, ensures uniform distribution of water to the atomizers, and excludes air as mentioned below.

During the water's continuing transit in the direction of the tip 70 of the head, the groove 68 is filled with water. As is the case with the shell, the swirling flow of water transfers heat to the cap, to warm it and lessen any tendency for freezing. In less preferred embodiments, the groove 68 may be eliminated. The still-swirling water flows further downstream within the cap, moving out of the groove and into the upstream ends, or interior openings, of the multiplicity of atomizers 34 which are equally spaced around the interior circumference of the cap. Simultaneously, pressurized air flows down the air tube 38 into the chamber 64. The pressurized air flows through the atomizers 34 with the water. Volumetrically, the chamber 64 is substantially filled with compressed air.

In the process which has been just described, there is minimal mixing of the water with the air until they both enter the entrances of the atomizers. This attributable to the places where they are separately introduced, and primarily to the high centrifugal velocity and G force of the water, which tends to exclude any air from intermingling with the water. Thus, the desired heating effect of the water on the cap is not disrupted by included air.

The combined flow of air and secondary water through the small 0.050–0.070 inch diameter of each atomizer straight-cylinder shape hole causes the water to disintegrate into fine droplets. The air in the chamber 64 will typically be at approximately 85 psig, and thus there is critical flow through the openings of each atomizer. Upon exit from the atomizer, the air expands and thereby reduces in temperature, from a typical infeed temperature of 30–60° F. to as low as a calculated minus 175° F. The flow of water to the front end of the nucleator can be controlled by modulating the input pressure to the nucleator, the restrictor plate gap(s) and the swirl plate 58 orifice size and number, or by other obvious factors.

The low temperature of expansion of air from the atomizers causes the water accompanying the air to freeze. There are two components to this water. First, there is the secondary water which is entrained with the air. Second, there is vapor which is present in the air. Both of these are converted into frozen particles by the cooling effect of the expanding compressed air. In an exemplary nucleator of the invention, the equivalent dry air flow might be at 0.127 lb/sec, the secondary flow at 0.111 lb/sec, and the water vapor (in the air) flow at 0.0001 lb/sec. Although the water vapor is comparatively small fraction of the total water weight passing through the atomizers, calculation indicates that the nuclei produced by it are considerably smaller and greater in number than the nuclei which are formed from the entrained secondary water. The water vapor nuclei are about 0.01–0.1 microns in diameter. "Diameter" as used for droplets or particulate herein refers to the Sauter mean diameter which is calculated by known techniques from the surface area to volume ratio. The secondary water nuclei are about 20 microns diameter. And, there will be about $10^{17}$ water vapor nuclei generated per second, compared to about $10^{11}$ secondary water droplets per second, both further compared to about $10^{10}$ primary water nuclei per second of about 180 microns diameter issuing from the nozzle (when the gross water flown is about 25 gpm).

Thus, it will be appreciated that the nucleator of the invention provides a bimodal distribution of particles as nuclei. One group (called "fine") has a mean diameter of about 20 micron and the other group (called "very fine") will have a mean diameter of less than about 0.1 micron. Obviously, as the air-water mix issues from the nucleator, the very fine particles may help induce freezing which forms the fine particles as the mix flows from the atomizer toward the droplets from the nozzles. As the nuclei of the mix intersect the flow of droplets from the nozzles, the fine particles, having more mass than very fine particles, and adding to their numbers, are believed to enhance the effectiveness of the nuclei stream, more than would be the case when secondary water is not passed through the atomizers.

The characteristic air flow and water flow parameters for a 16 nozzle nucleator with a nominal rating of 0.8 gpm and 75 scfm. The nucleator typically can operate at an air/water ratio (scfm/gpm) of almost 100:1, substantially higher that virtually all prior art nozzles. Typically, the unit will operate over a range of 60–90 scfm air flow and 0.4 to 0.8 gpm, to produce a 60–125–170 to 1 air/water ratio. Typically, the ratio is about 125:1. When a typical water flow through the nozzles of 25 gpm is additionally taken into account, the air/water ratio of the snowmaking head is nominally 3 or 4 to 1. When relative humidity is low, comparatively more primary water will be used, compared to when it is high. As supported by description above and below, the desirable high nucleator air/water ratios are obtainable due to the efficient use which is made of the secondary water in warming the nucleator, through the swirling, in a degree sufficient to avoid the freezing problems of prior art devices.

A further significance of the high air water ratio of the nucleator is in avoiding undue wetness of the nucleator output, even when adding secondary water. When the air water ratio is high, or the mix is kept comparatively dry, there is better freezing and formation of nuclei. In "wet plumes" droplets of water which are not frozen, i.e., fine droplets, can tend to annihilate (or melt) the very fine droplets which have already been frozen as nuclei. This is contrary to the objective of producing the most nuclei possible, in the context of other aims. As was presented above, the quantity of very fine nuclei formed from vapor is seven magnitudes greater than the quantity formed from secondary water. Therefore, one does not want to have secondary water droplets, necessarily present, annihilating the very fine particle nuclei.

Of most importance, the water flow to the nucleator serves the warming functions which have been described. And even if sufficient nuclei for the primary droplet flow may be generated at the atomizers without any flow of secondary water, in such case there is a tendency for the nucleator to freeze up. Thus, one way of looking at the secondary water flow through the nucleator is that it is simply for warming and is conveniently dumped through the atomizer. From such view point, the sufficiency of the secondary flow is determined by what is sufficient to prevent freezing on the external surface of the nucleator. The water flow through the atomizers ought not be of such quantity that the formation of nuclei is inhibited. While compressed air flow could be increased to compensate for increased secondary water flow, doing so is contrary to the aim of minimizing the consumption of compressed air.

Figure 7:
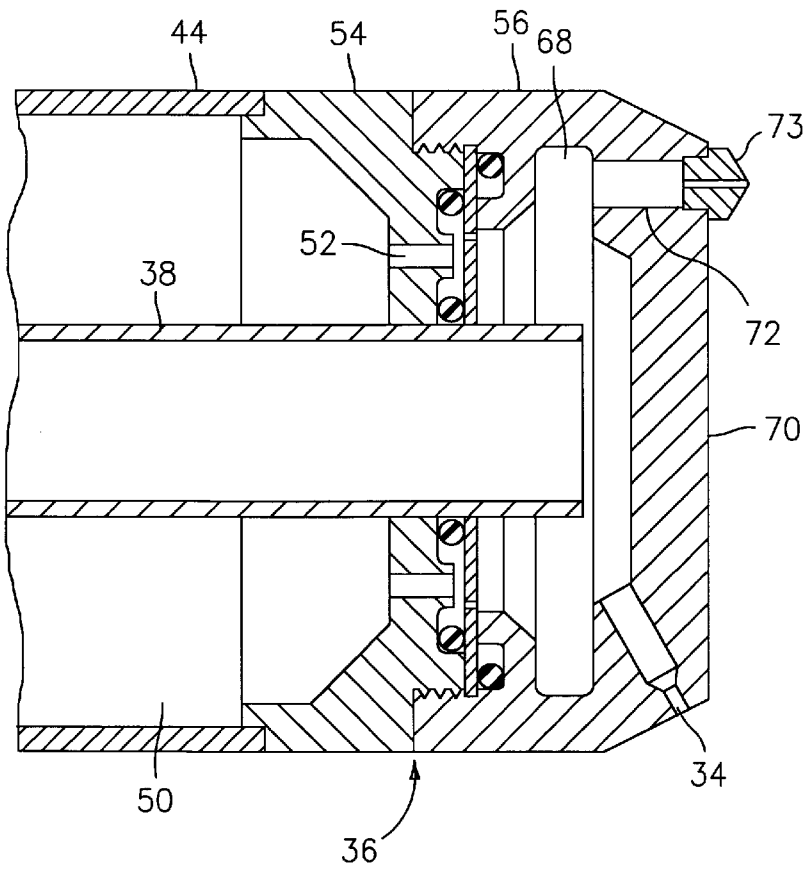
FIG. 7 shows a cross section like FIG. 5 of nucleator having an end cap with through holes.

A way of achieving additional water flow to a nucleator, while maintaining a desired ratio of air and water through the nucleator atomizers is shown in FIG. 7. A portion of the water, flowed to the head is caused to flow through one or more axial channels 72 and then through a flat spray pressure nozzle 73, schematically illustrated. The channel 72 shown runs from groove 68 through the cap 56 and exit on the front surface of tip 70 of the cap. The flow through channels 72 is referred to as tertiary water flow and there is no combination of such water with air flow. There will be a slight additional heating effect on the cap by the tertiary flow. Under some conditions, the flow through channels 72 might be as much as 50 percent of the flow of water through the nucleator, but in absolute terms it will be very small compared to the flow through the nozzles of the ring. The droplets sprayed from the atomizers 73 generally intermix with the mass of nuclei and primary water droplets flowing downstream, so the tertiary spray is nucleated and formed into snow.

Figure 8:
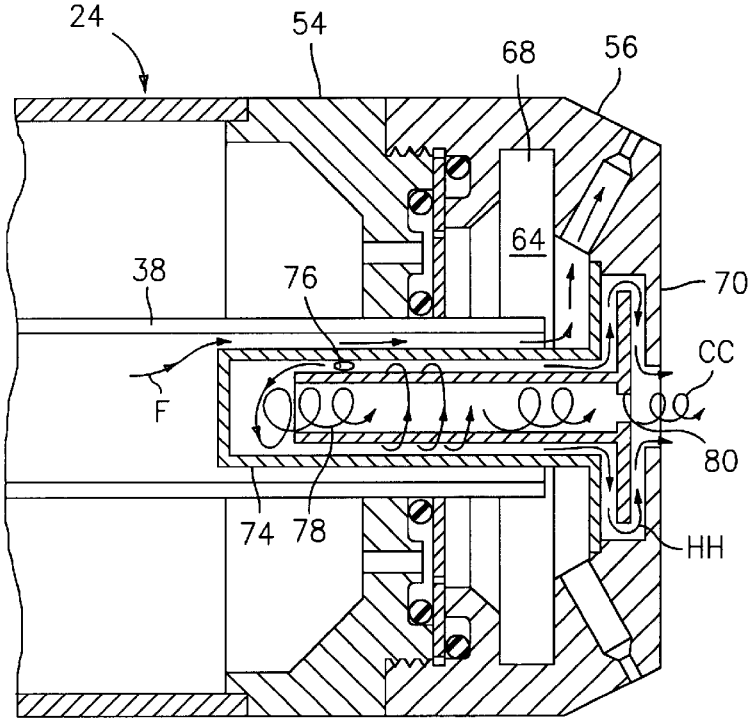
FIG. 8 shows a cross section like FIG. 5 of a nucleator having a vortex tube inside the front end.

FIG. 8 shows another embodiment of the invention, where a so-called Ranque-Hilsch tube, familiarly called a vortex tube, is used to help heat the tip 70 of the cap 56 of the nucleator. A vortex tube is a device which separates an air stream into hot and cool components. Vortex tubes are available commercially, but the one in the invention is custom fabricated. In the FIG. 8 device, air F flows down the air tube 38, into chamber 64 and through the atomizers as previously described. The vortex tube is comprised of an outer housing 74 having a tangential port 76 through which a fraction of the air flow F enters. The air swirls around the exterior diameter of the inner tube 78 and flows both up the axis of the head and down the axis of the head (to the left and the right in the Figure). That which flows upstream enters the bore of the inner tube 78, to then flow downstream, through orifice 80, and then exiting the tip of the head as stream CC. That fraction of the air which flows downstream flows radially outward around the flanged end of the inner tube, following a tortuous channel path indicated by arrows marked HH. The last part of the path HF is just below the surface of the tip 70. The nature of the vortex tube is such that the air flowing along the path HH will be comparatively warm and the air flowing along path CC is comparatively cold, relative to the temperature of the air flowing along path F, i.e., the source air. Thus, the cap tip 70 and parts along the flow path HH will be heated, to be kept above freezing. The colder air flowing along the path CC is essentially dumped, and any cooling of the metal parts along its flow path is not significant to unit operation. The relative amounts of air flowing along the paths CC and HF, and thus the comparative stream temperatures, are regulated by controlling the individual flow path resistances, for instance by changing the orifice 80 diameter and/or the width of the spaces along the flow path HH.

From the foregoing, it will be appreciated that different constructions and definitions of sub-components can be utilized to obtain the internal geometries which have been described as being advantageous. It will also be appreciated that compressed air can be delivered to the front end of the nucelator by other means than the central tube 38. Where water is clean, the nucleator can be utilized without the features which are aimed at trapping small solid particulates.

While the invention has been described in terms of having nozzles disposed about a circular ring, nozzles can be alternatively supported at the desired and functionally equivalent locations by other mountings. Rings may be of any shape. They may be solid with nozzles fed by other lines. And, particularly when they are comparatively few in number, the nozzles may alternatively be mounted at the ends of pipes radially extending from a manifold near the nucleator. Thus, the term ring as used herein in connection with nozzles and their mounting ought be construed to comprehend such variations of equivalent structures.

The methods of using the air and water to prevent nucleator surface freezing has the advantage of utilizing the energy sources in the water and compressed air which are necessarily provided to the head to make snow. While, obviously, other means for heating such as electric resistance wires or heated fluid closed loops could be utilized alternately or in combination with the invention, they require another energy source and more apparatus.

Figure 9:
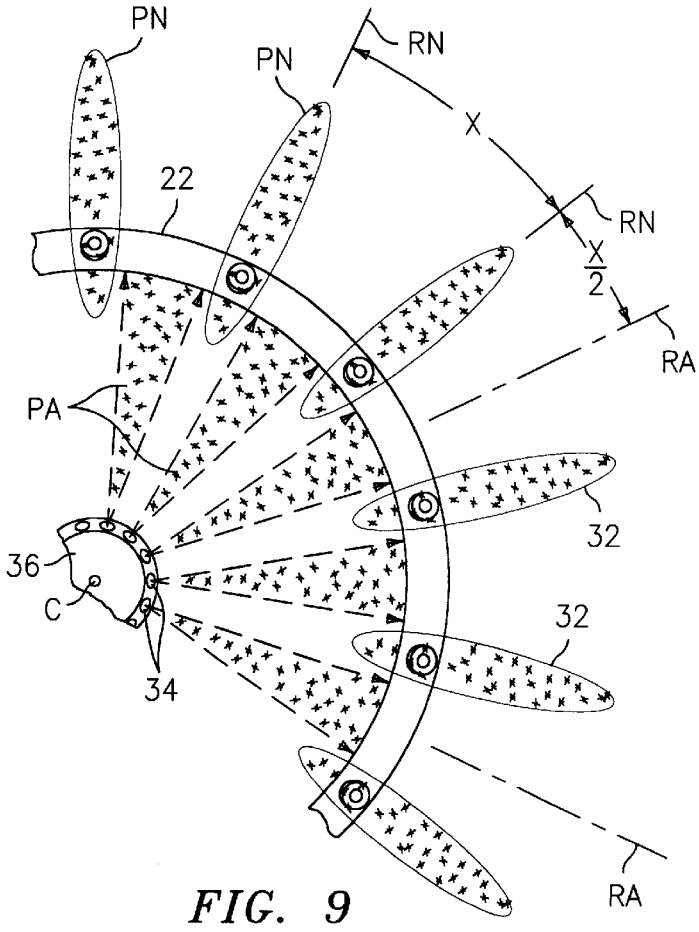
FIG. 9 is a view upstream along the central axis of a snowmaking head, showing, for a quadrant, the intersecting patterns of nuclei and primary water droplets discharged from flat spray pattern nozzles.

The number of atomizers is often preferably equal to, or less than, the number of nozzles. Both nozzles and atomizers are symmetrically disposed around the circumference of axis C. Preferably, pattern of the nozzles is rotationally offset one-half phase from the pattern of the nozzles. One preferred configuration is shown in FIG. 9 which is a view of a head and spray pattern from a cross section plane, looking back up along axis C from short distance downstream of the head (for example, about one foot downstream of a head having a nominal 2 foot diameter primary water ring). The head has equal numbers of nozzles and atomizers. As shown, the nozzles 32 and their spray pattern cross sections PN lie along a first set of radii RN running from the axis C, which radii are equally spaced apart by x degrees; and, each atomizer 34 lies along a second set of radii RA running from the axis C. The radii sets are offset relative to each other, so that, when viewed along the length of the axis, each of the atomizer radii lies at a bearing which is one-half x degrees from the closest nozzle radius. Thus, each atomizer sends nuclei radially outwardly and downstream, as described elsewhere, so the nuclei form a narrow conical plume PA (having nominally 8 degree divergence) along a path which is intermediate the centerlines of the primary water droplet plume patterns from the spaced apart nozzles. Of course, as each nozzle plume continues downstream, the water droplets diverge or spread tangentially, so that the flat spray patterns become merged into a generally cylindrical plume. But since nuclei are injected into spaces between the nozzle spray patterns before they merge, there is very good mixing of the nuclei and primary water droplets, and thus good snow formation. Aligning the oblongs of the flat spray patterns radially as described also minimizes the effect of the pattern of one nozzle interacting with that of an adjacent nozzle. When the adjacent patterns interact to a great extent before moving a good distance downstream, there can be coalescing of the droplets from the two patterns, or undue concentration of droplets, resulting in regions which have too many droplets to be properly nucleated, and which therefore result in liquid or slushly particles, instead of the desired frozen snow, falling to the earth.

Figure 10:
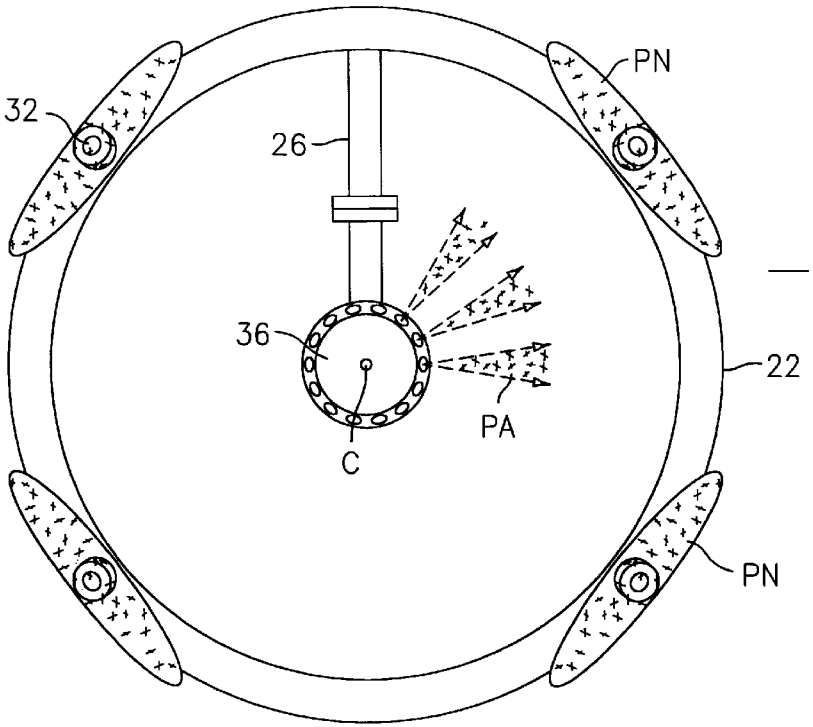
FIG. 10 is a view like FIG. 11 showing a full head with a different number and orientation of flat spray pattern nozzles.

FIG. 10 is a view like FIG. 9, showing a head with four flat-spray pattern nozzles and 16 atomizers. The nozzle spray pattern cross sections are oriented so the lengths of the oblongs are perpendicular to the radii running from the centerline C. Since the nozzles are spaced apart sufficiently around the ring, and since the adjacent patterns of four nozzles are perpendicular to each other, there is limited opportunity for the overlap, coalescing, etc. which was just mentioned. Generally, in the invention, the number of atomizers equals or exceeds the number of atomizers, to ensure adequate distribution of nuclei.

Other variations in numbers of atomizers and nozzles will be configured accordingly. Less preferably, the principles of the invention can be carried out when conical nozzles are used, since when the nozzles are significantly spaced apart there is still space, albeit less, between the adjacent spray patterns for interjecting the nuclei.

In the part of the description which follows, some illustrative dimensions and parameters are given for one embodiment of head which is comprised of a preferred number of 16 ring nozzles and 16 nucleator atomizers. The configuration is like that shown in FIG. 1. The nozzles are equally spaced apart around the ring of about 12 inch radius. The head has about 3 inch outside diameter and about a length of about 6–12 inch. The primary water flow to the nozzles is about 24–48 gpm water at about 150–350 psig . The flow of the water to the head is about 0.4–0.8 gpm. The compressed air flow to the nucleator, and thus the atomizers, is about 65–90 scfm (standard cubic feet per minute) at a pressure of about 85–100 psig.

The nozzles and atomizers generally respectively propel the primary water droplets and the nuclei in the C axis downstream direction, but in a way such that the basic flow paths diverge from the axis C. As illustrated in FIG. 2, the water spray nozzles 32 discharge spray along a basic flow path or axis W which is also diverging from the C axis, to increase the area where snow will be deposited. The axis W runs at a lesser angle to the central axis C than does the corresponding basic flow path or axis N along which the atomizers discharge nuclei. Preferably, the angle A of each atomizer is in the range 45 to 60, most preferably 60 degrees to the C axis; and the angle B of each nozzle is in the range 0 to 30, most preferably 5 degrees to the C axis. Thus, the flow from the nucleator atomizers intercepts the circumferential plume formed by the expanding flow patterns from the nozzles. While other angling with respect to the C axis of the respective nozzle and atomizer spray patterns is possible within the context of the invention, generally, if the nozzle flow is made to converge sharply toward the centerline and the atomizers are aimed along the centerline, inferior snow making will result. And, while less preferred, within the generality of the invention, the nozzles can be made to lay along another path around the centrally located nucleator. For example, they may be arranged on a rectangular pattern. As a further example the nozzles may be organized such that they are staggered in different downstream planes. While within the generality of the invention, there could be only one atomizer and one nozzle, such a device would have relatively little use insofar as rapidly covering earth with snow. More practically, there are at least 4 nozzles (and 4 or more atomizers).

As shown in FIG. 2, the plane in which the atomizers lie is preferably downstream of the plane in which the nozzles lie by a distance L of about 6 inch. Less preferably, the distance L is negative, that is the cap of the nucleator is upstream of the array of nozzles.

The nozzles are pressure atomizers, wherein the fluid flowing through the nozzle is caused is to breakup into a spray by swirl and shear during passage through the nozzle. A spray of water droplets of sufficient fineness is provided, such that they will become frozen before they drop to the earth in the dynamic process described just above. The critical fineness of nozzle droplets will vary according to the ambient conditions, temperature of water, and other parameters at the particular ski-slope or other place where snow is being deposited. For general use, a preferred nozzle is a Vee Jet Series type nozzle (Spraying Systems Co., Wheaton, Ill.) or a NF Series type nozzle (Bete Fog Nozzle Co., Greenfield, Mass.). Typically all nozzles in a ring will be of similar type and gpm rating. The flow rating of an individual nozzle would be selected according to the total flow desired and the number of nozzles present. The total gpm flow through the nozzle ring will be dictated by the ambient conditions and the performance of the nucleator.

Because its ability to reliably generate nuclei in large quantity, with a high air water ratio, and the ability to inject the nuclei into particularly disposed primary water spray patterns, the snowmaker of the present invention exhibits superior performance at comparatively higher temperatures.

In use, a head is connected to an air and water supply. By means of suitable valving at source of air and water, air is first flowed to the head; and then the water is flowed. After the desired quantity of snow has been made, the water is shut off, and then the air. Water can be drained from the nucleator and ring by suitable drains in the supply lines, or by additional fittings.

Figure 11:
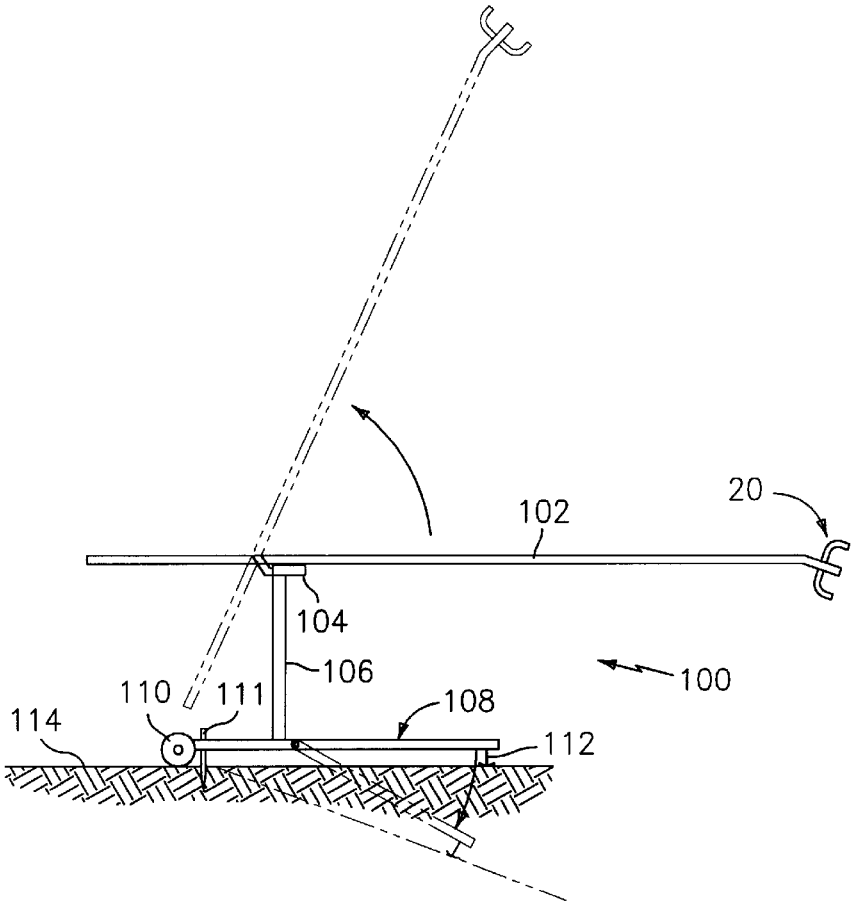
FIG. 11 is an elevation view of a tower for supporting a snow making head on both a level surface and a sloped surface, shown in phantom.
Figure 12:
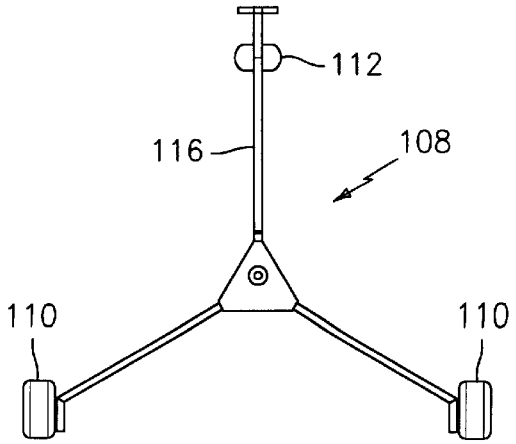
FIG. 12 is a top view of the base of the tower shown in FIG. 10.

The head 20 is preferably mounted atop a light weight portable tower 100 as schematically shown in FIG. 10, inasmuch as the head is able to have a light weight. (In comparison, fan type units inherently tend to be heavy.) The head is mounted at the end of a boom 102 through which water and air co-axially flow; typically the head is at an about 45 degree angle to the boom.. The boom pivots off a support 104. It rotates from the stored horizontal position to the raised position shown in phantom, which ranges up to 90 degrees from horizontal. Typically, in full extension the boom will be about 21 feet from horizontal terrain. There is suitable structure for locking the boom in a desired angle position, and springs or gas struts, for counterbalancing the boom weight, neither of which are shown. The support 104 is at the top of upright 106 which extends from base 108. The support may rotate about the upright so the head can point in different directions. The base 108 of the tower is shown in top view in FIG. 11. The base 108 has three arms or spokes. At the ends thereof are two wheels 110 and a pad 112. Near each wheel is a vertically slidable spike 111, for pining the base against movement along a snow slope. The arm 116 is pivoted, so as shown in FIG. 10 in phantom, the arm and pad thereon can be rotated downwardly (and locked in place by lock means, unshown) when the surface of the earth 114 is sloped instead of level.

The invention works by discharging droplets and nuclei into air which is not being induced to move, such as by a propeller fan. The flow of water from the nozzles and the intersection flow of air and nuclei from the nucleator combine to form a total plume which is thrust axially downstream from the head, in major part due to the momentum of the primary water droplets. There is a certain induced air flow due to operation of the head, and the combined effect is that artificial snow is desirably carried a distance from the head. While the projection of the head is not so great as it is for snowmakers with fans, the light weight and easy maneuverability of the invention make it well suited for covering large areas with artificial snow.

Although this invention has been shown and described with respect to a preferred embodiment, it will be understood by those skilled in this art that various changes in form and detail thereof may be made without departing from the spirit and scope of the claimed invention.

I claim:

1. A device for making snow, by use of pressurized water and compressed air, which comprises:

means for dividing a flow of pressurized water into a primary water flow and a secondary water flow;

means for disintegrating the primary water flow into a multiplicity of water droplets flowing generally downstream along the path of a central axis; and, a nucleator, having an upstream end and a downstream end, and a plurality of atomizers at the downstream end; the nucleator merging the flow of secondary water with a flow of compressed air and discharging the water and air from the plurality of atomizers to form a multiplicity of frozen particle nuclei flowing generally along said axis, so the nuclei intermingle with said multiplicity of primary water droplets to induce said droplets to freeze as snow; the nucleator having a first chamber for receiving secondary water; and, means for causing swirling flow of secondary water inside the first chamber, to thereby cause heat transfer from the secondary water to the nucleator when the nucleator is exposed to external temperatures less than the freezing point of water.

2. The device of claim 1 wherein the means for disintegrating primary water comprises a plurality of spaced apart nozzles disposed around said axis; wherein the plurality of atomizers is disposed around said axis, said atomizers located closer to said axis than said nozzles.

3. The device of claim 2 wherein the compressed air and water are separately introduced into said first chamber; and, wherein nucleator further comprises: a circular interior shape end cap at the downstream end of the nucleator; said end cap forming in part said first chamber; said atomizers spaced apart around said cap, in flow communication with the first chamber; wherein, said means for swirling causes a predominant circumferential velocity component within said end cap, to thereby distribute water evenly to the atomizers, transfer heat to the end cap, and separate the flow of secondary water from the flow of compressed air upstream of said atomizers.

4. The device of claim 3 wherein the cap has an interior circumferential groove which is filled with swirling water during use, said atomizers connected to the downstream end of said groove.

5. The device of claim 1 wherein the nucleator further comprises:

a second chamber located downstream of the first chamber and in communication therewith;

a circular interior shape end cap at the downstream end of the nucleator; wherein, said second chamber is formed in part by said end cap; wherein said atomizers are spaced apart around said cap proximate the outer circumference thereof; and, means for causing swirling water flow in the second chamber, with a predominant circumferential velocity component within said end cap, between the first and second chambers.

6. The device of claim 5, wherein the secondary water contains solid particulate, further comprising:

a pipe running along the length of the central axis of the first chamber, to provide the first chamber with an annular cross section having an inside diameter and an outside diameter;

wherein said swirling first chamber flow induces the solid particulates in the secondary water to flow radially outward under centrifugal force and to concentrate in water near said outside diameter; and, a first orifice plate, for inhibiting movement of said solid particulates from the first chamber to the second chamber.

7. The device of claim 6, further wherein said first orifice plate has a plurality of through holes radially positioned between the inside and outside diameters of the first chamber, so water flowing from the first chamber to the second chamber is predominantly water other than that near the outside diameter, where solid particulates are concentrated by centrifugal force.

8. The device of claim 1, wherein the means for causing secondary water to flow through the first chamber in swirling fashion comprises an orifice plate having tangentially oriented openings located near the upstream end of the first chamber; said nucleator further comprising a disk, positioned upstream of said orifice plate, the disk circumferentially defining with the interior of the nucleator a narrow radial gap, for inhibiting the flow of solid particles contained in the water supply into the first chamber.

9. The device of claim 1, wherein, the means for disintegrating the primary water comprises a plurality of nozzles spaced apart around a central axis; each said nozzle discharging a multiplicity of water droplets generally downstream along a first path; wherein the nucleator lies along said central axis; the nucleator mixing and discharging secondary water and pressurized air to thereby provide said multiplicity of frozen particles suitable for interacting with the multiplicity of water droplets and inducing said droplets to freeze; wherein the atomizers are circumferentially spaced apart, each atomizer thrusting said frozen particles along a second path which runs radially outwardly and intersects the first path downstream of the nucleator; and, wherein each nozzle provides a flat spray pattern having an oblong cross section with a length and a width, wherein the length of said oblong cross section runs radially from the central axis.

10. The device of claim 9 wherein the number of said nozzles is equal to the number of said atomizers.

11. The device of claim 1, wherein, the means for disintegrating the primary water comprises a plurality of nozzles spaced apart around a central axis; each said nozzle discharging a multiplicity of water droplets generally downstream along a first path; and, wherein the nucleator lies along said central axis; the nucleator mixing and discharging secondary water and pressurized air to thereby provide said multiplicity of frozen particles suitable for interacting with the multiplicity of water droplets and inducing said droplets to freeze; wherein the atomizers are circumferentially spaced apart, each atomizer thrusting said frozen particles along a second path which runs radially outwardly and intersects the first path downstream of the nucleator; wherein the nozzles and atomizers are relatively oriented circumferentially so that the first paths and second paths are radially interleaved, so that nucleator discharges frozen particles predominantly in radial regions which lie between said spaced apart first paths.

12. The device of claim 11 wherein each nozzle provides a flat spray pattern having an oblong cross section with a length and a width, wherein the length of said oblong runs radially from the central axis.

13. The device of claim 1, wherein said nucleater has means for merging secondary water and compressed air internally; the nucleator discharging the mixture of air and water from the plurality of atomizers; said means for swirling secondary water within the nucleator positioned upstream of said atomizers; wherein the ratio of secondary water flow, measured in gallons per minute, to compressed air flow, measured in standard cubic feet per minute, is greater than 60:1.

14. The device of claim 13 wherein said ratio is greater than 100:1.

15. The device of claim 1, further comprising a portable tower; the nucleator and means for disintegrating mounted atop the tower; wherein the tower is comprised of a base; a vertical support extending upward from the base; and, a boom pivotably mounted on the support for selectively fixed positioning at 0–90 degrees from the vertical support; the base having three arms lying in a horizontal plane relative to the vertical support; two arms fixed and having wheels mounted at the ends thereof, the third arm having a pad; wherein the third arm is pivotably adjustable in the vertical plane.

16. A device for making snow by use of a flow of pressurized water and a flow of compressed air, which comprises:

means for dividing the flow of pressurized water into a primary water flow and a secondary water flow;

means for disintegrating the primary water flow into a multiplicity of water droplets flowing generally downstream along the path of a central axis;

a nucleator; for providing a multiplicity of frozen particulates from a plurality of atomizers, and for projecting the particulates so they intermingle with said multiplicity of water droplets to induce said droplets to freeze as snow, the nucleator having a discharge end and a chamber in proximity to said end;

a plurality of atomizers circumferentially spaced apart around said chamber and in communication therewith;

means for introducing compressed air into said chamber; and, means for introducing secondary water into said chamber upstream of said atomizers, and for flowing said water axially and circumferentially within said chamber; wherein the secondary water flow and air flow are first intermingled upon entering said atomizers.

17. A device for making snow through use of a flow of pressurized water and a flow of compressed air, which comprises:

means for dividing the flow of pressurized water into a primary water flow and a secondary water flow;

a plurality of nozzles spaced apart around a central axis, for disintegrating the primary water flow into a multiplicity of water droplets, each nozzle discharging a multiplicity of water droplets generally downstream along a first path, wherein the first path diverges radially outwardly from said central axis; and, a nucleator, lying along said central axis, for mixing and discharging secondary water and compressed air to thereby provide a multiplicity of frozen particle nuclei suitable for interacting with the multiplicity of water droplets and inducing said droplets to freeze as snow;

the nucleator having a plurality of circumferentially spaced apart atomizers, each atomizer discharging said frozen particle nuclei along a second path which path diverges radially outwardly from said central axis to a greater degree than said first path.

18. The device of claim 17 wherein each first path lies at an angle of 1–30 degrees to said central axis.

19. The device of claim 17 wherein each nozzle provides a flat spray pattern having an oblong cross section with a length and a width, wherein the length of said oblong cross section runs perpendicular to a radius running from the central axis.

20. A device for making snow through use of a flow of pressurized water and a flow of compressed air, which comprises:

means for dividing the flow of pressurized water into a primary water flow and a secondary water flow;

a plurality of nozzles spaced apart on a ring around a central axis, for disintegrating the primary water flow into a multiplicity of water droplets, each said nozzle discharging a multiplicity of water droplets generally downstream along a first path; and, a nucleator, lying along said central axis, for mixing and discharging secondary water and compressed air to thereby provide a multiplicity of frozen particles suitable for interacting with the multiplicity of water droplets and inducing said droplets to freeze as snow;

the nucleator having a plurality of circumferentially spaced apart atomizers, each atomizer discharging said frozen particles along a second path which runs radially outwardly and intersects the first path downstream of the nucleator;

wherein said means for dividing the flow comprises a distributor pipe running between the nucleator and said ring; and, coupling means along the length of the distributor pipe, for coupling and uncoupling the ring from the nucleator.

21. The method of making artificial snow using a nucleator having a plurality of atomizers, compressed air and water, which comprises:

providing a flow of water and dividing the flow into a primary flow and a secondary flow, creating a spray of droplets from the primary flow of water and thrusting the droplets generally along an axis;

swirling the secondary flow of water flow within the nucleator, without inclusion of intermixed compressed air, to thereby warm the nucleator; and, then mixing the secondary flow of water with the compressed air and discharging the mixture from the nucleator atomizers to thereby form nuclei which intermix with the spray of droplets and cause the droplets to freeze as artificial snow.

22. The method of claim 21 wherein the ratio of secondary water flow which is mixed with compressed air flow is at least 60 gallons per minute of water to 1 standard cubic foot per minute of air.

23. The method of claim 21 which further comprises swirling the secondary water in a first chamber of the nucleator to thereby cause solid particulates in the water to move radially outwardly from the water to a circumferential location; and, flowing the secondary water from the first chamber from a radial location located inward from said circumferential location, into a second chamber, thereby cause the solid particulates to remain in the first chamber;

wherein, said second chamber has said plurality of atomizers connected thereto.

* * * * *